US010374311B2

(12) United States Patent
Faraone et al.

(10) Patent No.: US 10,374,311 B2
(45) Date of Patent: Aug. 6, 2019

(54) ANTENNA FOR A PORTABLE COMMUNICATION DEVICE

(71) Applicant: MOTOROLA SOLUTIONS, INC, Chicago, IL (US)

(72) Inventors: Antonio Faraone, Fort Lauderdale, FL (US); Giorgi Bit-Babik, Plantation, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 44 days.

(21) Appl. No.: 15/840,623

(22) Filed: Dec. 13, 2017

(65) Prior Publication Data

US 2019/0181556 A1 Jun. 13, 2019

(51) Int. Cl.

| | |
|---|---|
| ***H01Q 5/371*** | (2015.01) |
| ***H01Q 1/24*** | (2006.01) |
| ***H01Q 5/328*** | (2015.01) |
| ***H01Q 21/00*** | (2006.01) |
| ***H01Q 9/04*** | (2006.01) |
| ***H01Q 13/08*** | (2006.01) |
| ***H01Q 5/47*** | (2015.01) |

(52) U.S. Cl.
CPC ..... *H01Q 5/371* (2015.01); *H01Q 1/243* (2013.01); *H01Q 5/328* (2015.01); *H01Q 5/47* (2015.01); *H01Q 9/0407* (2013.01); *H01Q 13/08* (2013.01); *H01Q 21/0037* (2013.01)

(58) Field of Classification Search
CPC ..... H01Q 5/47; H01Q 13/08; H01Q 9/0407; H01Q 5/328
USPC ..... 343/767
See application file for complete search history.

(56) References Cited

U.S. PATENT DOCUMENTS

| | | | | |
|---|---|---|---|---|
| 6,266,026 | B1 | 7/2001 | Stengel, Jr. | |
| 7,502,638 | B2 | 3/2009 | Shimizu et al. | |
| 9,136,588 | B2 | 9/2015 | Grossman et al. | |
| 9,923,272 | B2 * | 3/2018 | Sorensen | H01Q 7/005 |
| 10,181,885 | B2 * | 1/2019 | Ko | H04B 7/0639 |
| 10,200,092 | B1 * | 2/2019 | Irci | H04B 5/02 |
| 10,236,949 | B2 * | 3/2019 | Wu | H04B 7/0456 |
| 2013/0321212 | A1 | 12/2013 | O'Shea et al. | |
| 2014/0055211 | A1 | 2/2014 | Segador Alvarez | |
| 2015/0029059 | A1 | 1/2015 | Grossman et al. | |

* cited by examiner

*Primary Examiner* — Brian K Young
(74) *Attorney, Agent, or Firm* — Barbara R. Doutre

(57) ABSTRACT

An antenna (100) enables improved multi-band operation for a portable communication device, such as a portable two-way radio. The antenna structure is formed of a first radiator element (104) fed through a single radio frequency (RF) feed port (118) and terminated on the input of a transmission line (108). The transmission line (108) is routed along a ground plane reference mass (102) towards a second radiator element (106). Applying the antenna structure to a radio embodiment, the first radiator element (104) is placed at a bottom side of a portable radio device, the first radiator element being fed through the single RF feed port and terminated on the input of the transmission line. The transmission line is routed along the ground plane reference mass towards the second radiator element placed on a top side of the portable radio.

20 Claims, 5 Drawing Sheets

ANTENNA FOR A PORTABLE COMMUNICATION DEVICE

FIELD OF THE DISCLOSURE

The present invention relates generally to antennas and more particularly to antennas for multi-band applications for portable communication devices.

BACKGROUND

Radio communication devices, such as two-way portable radios, rely on good antenna performance for reliable communications. Such devices are often used by public-safety agencies such as police departments, fire departments, emergency medical responders, and the military to name a few. There is an increased interest in the public-safety arena for portable two-way radios equipped with antenna structures that enable operation over multiple communication frequency bands to enhance interoperability amongst the different public-safety agencies. Typically, antenna structures are either internal or external to the radio housing. While separate external antenna structures may be used to cover multiple frequency bands or achieve other functional benefits (e.g., receive diversity, radiation pattern beam steering, to name a few), the use of multiple separate external antenna structures is impractical in view of the size constraints of the portable devices as well as the encumbrance associated with increased device height potentially associated with multiple external antenna structures. Portable communication devices incorporating prohibitively large, lengthy and/or stiff external antenna structures can be cumbersome for a user to wear on the body and are also susceptible to breakage under extreme use condition in mission-critical public-safety settings. Hence, there is a need to provide single- and multi-band operation without significantly increasing the size of the overall device or negatively impacting performance. Challenges associated with the design of single- and multi-band antenna configurations include, but are not limited to, operational bandwidth, efficiency of operation, and size constraints.

Accordingly, there is a need for an improved antenna for portable radio applications.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1A:
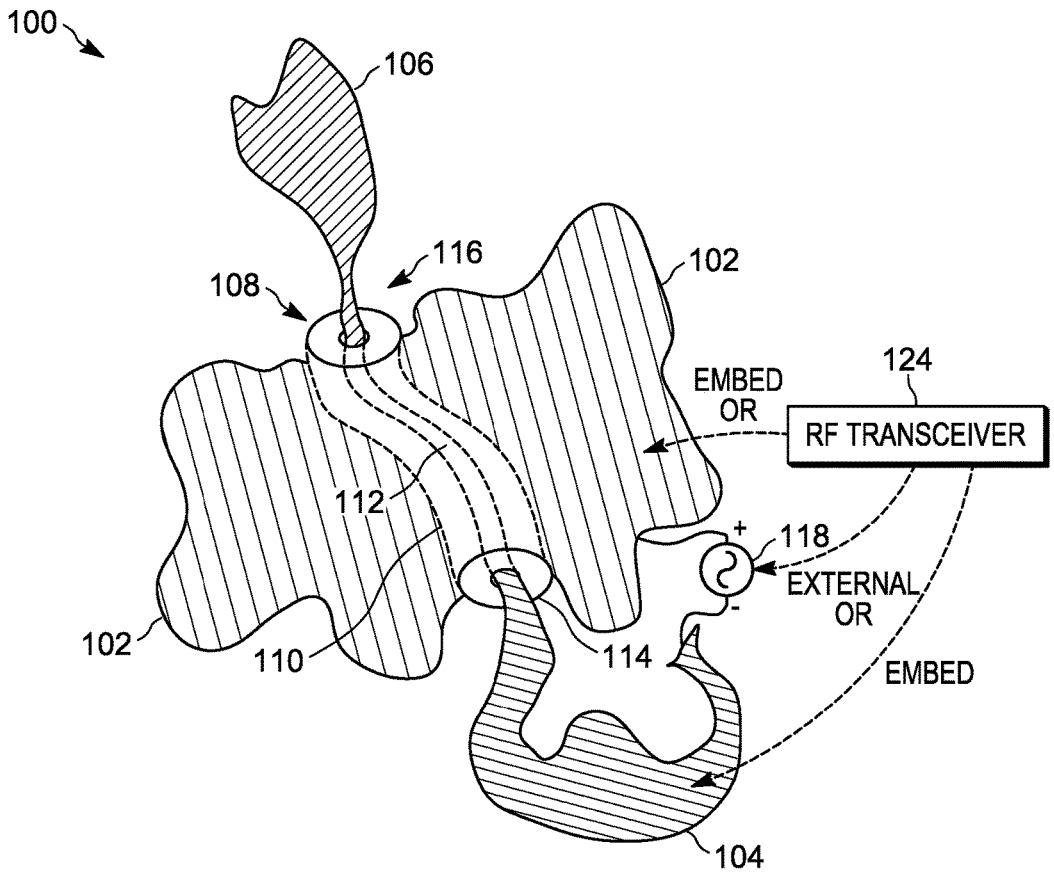
FIG. 1A is an antenna structure formed in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is provided herein an antenna structure that enables improved multi-band operation for a portable communication device, such as a portable two-way radio. The antenna structure is formed of a first radiator element fed through a single radio frequency (RF) feed port coupled to a ground reference mass, and coupled to a first end of a RF transmission line. The transmission line is embedded within or routed along the ground reference mass towards a second end of the RF transmission line, where a second radiator element is coupled to the RF transmission line.

Applying the antenna structure to a portable radio device embodiment, a first radiator element is placed at a bottom side of a portable radio device, the first radiator element being fed through a single RF feed port coupled with a radio ground reference structure, and coupled to the first end of a transmission line. The transmission line is embedded within or routed along the radio ground reference structure towards a second radiator element placed on a top side of the portable radio, which is coupled to a second end of the transmission line. The single combined antenna structure can provide operation at one or more frequency bands, such as for instance a very high frequency (VHF) band (about 136-174 MHz), and/or an ultra high frequency (UHF) band (about 380-520 MHz), and/or a 7/800 MHz frequency band (about 764-869 MHz) corresponding to public-safety communication services. The antenna structure described herein provides optimal performance for a handheld device while maintaining a useable device form factor. A portable radio incorporating the antenna structure of the various embodiments is particularly advantageous for public-safety operators, such as those employed in police departments, fire departments, emergency medical responders, and the military as the antenna structure described herein enables reliable interoperability between agencies operating in different frequency bands, along with an improved easy to wear, superior communication performance, and rugged form factor.

Figure 1B:
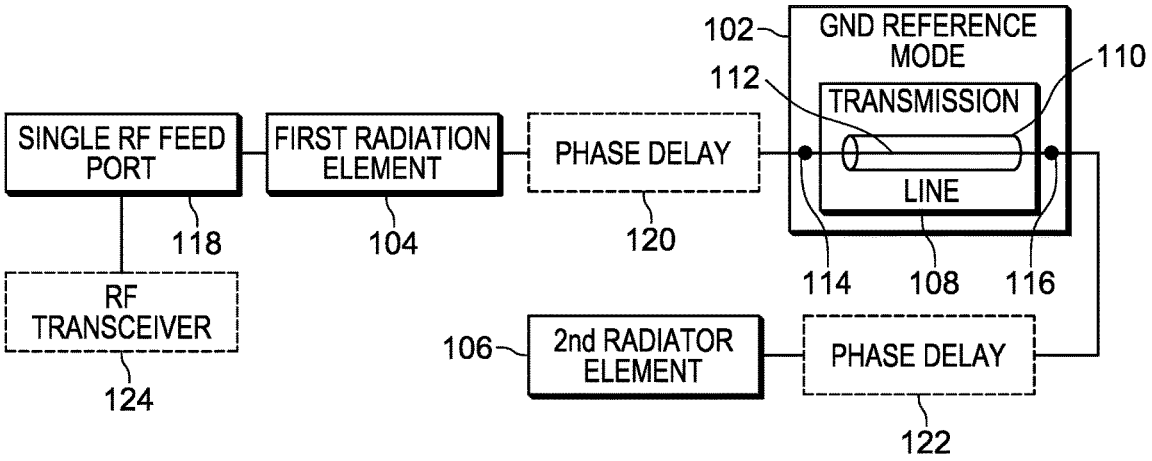
FIG. 1B is a block diagram for an antenna structure formed in accordance with some embodiments.

FIG. 1A depicts an antenna structure formed in accordance with some embodiments, and FIG. 1B is a block diagram for an antenna formed in accordance with the structure being coupled to a single transceiver. Referring initially to FIG. 1A, the antenna 100 comprises a ground reference mass 102, a first radiating element 104, a second radiating element 106, a RF transmission line 108 having a RF transmission line ground structure 110 and a RF transmission line signal structure 112 running between a first end 114 and a second end 116 of the RF transmission line 108, and a single RF feed port 118. At any predefined frequency of operation, the RF feed port 118 is characterized by a source impedance, while the antenna structure (comprising at least the first radiator element 104, the second radiator element 106, the RF transmission line 108, and the ground reference mass 102) is characterized by an input impedance, which in some embodiments may be an impedance other than 50 ohms, where antenna performances in terms of bandwidth and efficiency are at least in part dependent on the impedance match between source and antenna structure. The single RF port and the antenna structure provide appropriate impedance matching to maximize radiation efficiency. In accordance with the embodiments, the ground reference mass 102 may comprise one or more of: a metal chassis, PCB ground plane, interconnecting interfaces, and the like, forming a suitable support for RF currents to flow. The RF transmission line 108 runs embedded within or along the ground reference mass 102, or both, from one location of the mass to another location of the mass. The RF transmission line 108 is drawn in dotted lines in FIG. 1 to represent the case where RF transmission line 108 runs embedded within the ground reference mass 102. In some embodiments, the RF transmission line 108 partially runs along the ground reference mass 102 and partially is embedded in the ground reference mass 102, with the portion of RF transmission line ground structure 110 that runs along the ground reference mass 102 strongly coupled (galvanically and/or capacitively) with the ground reference mass 102. For instance, the RF transmission line 108, embodied as a coaxial cable, may partially run along the external surfaces of the mass, with its ground structure 110 held with grounding clips against the mass. Hence, whether internally embedded or externally coupled or a combination thereof, the RF transmission line ground structure 110 is part of the ground reference mass 102. In accordance with the embodiments, providing the RF transmission line ground structure 110 as part of the ground reference mass 102 helps minimize antenna detuning effects, as compared to the detuning effects that would occur if the coaxial cable were to run along the external surface of the ground reference mass without being grounded or strongly capacitively coupled to it which would establish predominantly opposing currents supported on the exterior surface of RF transmission line ground structure 110 (e.g. coaxial cable braided conductor) and the ground mass 102 and have deleterious effects on the antenna impedance matching, thus negatively impacting efficiency and bandwidth.

In accordance with the embodiments, the first radiating element 104 and the second radiating element 106 are each electromagnetically coupled to the ground reference mass 102 at opposite ends of the RF transmission line 108. The single RF port 118 may be established between the ground reference mass 102 and first radiating element 104 in a number of ways. For example, the single RF port 118 may be realized by coupling first radiator element 104 to a signal terminal of a RF transceiver 124, wherein the RF transceiver 124 is embedded within the ground reference mass 102. Alternatively, the single RF port 118 may be realized by coupling ground reference mass 102 to a signal terminal of a RF transceiver 124, wherein the RF transceiver 124 is embedded within the first radiating element 104. In yet a further alternative approach the single RF port 118 may be realized by a separate structure, of an externally coupled RF transceiver, having two signal terminals with one terminal coupled to first radiator element 104 and the other terminal coupled to ground reference mass 102. In all three cases, the first radiating element 104 is electromagnetically excited by the single RF feed port 118 and electromagnetically coupled to the RF transmission line signal structure 112 at the first end 114 of the RF transmission line 108, while the second radiating element 106 is similarly electromagnetically coupled to the signal structure 112 at the second end 116 of the RF transmission line.

In accordance with some embodiments, the second radiator element 106 may be tuned and matched concurrently with the first radiator element 104 for a predetermined frequency response in a first set of frequency bands. In accordance with the embodiments, the second radiator 106 is predominantly self-reliant for a predetermined response for operation in a second set of frequency bands, where the first radiator element 104 operates mainly as a RF pass-through that introduces a predetermined phase-delay. The antenna configuration thus enables multiband operation where the first and second radiator elements 104, 106 are simultaneously electromagnetically excited by the single RF feed port 118.

For example, the second radiator element 106 may be tuned and matched concurrently with the first radiator element 104 for a predetermined response in an UHF band and a 7/800 MHz band, while the second radiator 106 is predominantly self-reliant for a predetermined response for operation in a VHF band. This operation is possible since the wavelength in the VHF band is significantly longer than in the UHF and 7/800 MHz bands, therefore the first radiator element 104 can be designed to operate as an electrically-small RF pass-through element in the VHF band, while preserving desirable frequency dependent behaviors in the UHF and 7/800 MHz bands. Across all bands, the RF transmission line operates as a RF pass-through that introduces a predetermined signal transfer function to signals applied at either end 114 and 116. Such an arrangement can be summarized in the following

TABLE 1

| Frequency Band | First Radiator Element 104 | Transmission Line 108 | Second Radiator Element 106 |
|---|---|---|---|
| 7/800 MHz | Tuned for 7/800 MHz | Operates as Pass through | Tuned for 7/800 MHz |
| UHF | Tuned for UHF | Operates as Pass through | Tuned for UHF |
| VHF | Operates as Pass | Operates as through | Tuned for VHF Pass through |

An alternative embodiment may feature the first radiator element 104 tuned only for 7/800 MHz and behaving as an electrically-small RF pass-through element in the VHF and UHF bands, as summarized in the following

TABLE 2

| Frequency Band | First Radiator Element 104 | Transmission Line 108 | Second Radiator Element 106 |
|---|---|---|---|
| 7/800 MHz | Tuned for 7/800 MHz | Operates as Pass through | Tuned for 7/800 MHz |
| UHF | Operates as Pass through | Operates as Pass through | Tuned for UHF |
| VHF | Operates as Pass through | Operates as Pass through | Tuned for VHF |

A further alternative embodiment may feature both the first radiator element 104 and the second radiator element 106 tuned only for 7/800 MHz, thus implementing a single-band antenna operation as summarized in the following

TABLE 3

| Frequency Band | First Radiator Element 104 | Transmission Line 108 | Second Radiator Element 106 |
|---|---|---|---|
| 7/800 MHz | Tuned for 7/800 MHz | Operates as Pass through | Tuned for 7/800 MHz |
| UHF | Not supported | Arbitrary operation | Not supported |
| VHF | Not supported | Arbitrary operation | Not supported |

The electrical length of the transmission line 108 controls the behavior of the antenna 100. In particular, the efficiency, bandwidth, and radiation pattern characteristics of antenna 100 depend on the RF signal transfer function imposed by transmission line 108, which is a key aspect of the design of antenna 100. For example, the shape of the radiation pattern of antenna 100 depends on the RF transmission line 108 signal transfer function, therefore the communication range performance of a portable radio device incorporating antenna 100 depends on that transfer function as well. The limited spacing within a portable radio housing also limits the length of the transmission line 108. To address space constraints and facilitate control of the RF transmission line 108 signal transfer function, for instance the phase delay it introduces in different frequency bands, phase delay circuits may be incorporated into the antenna 100. Referring to FIG. 1B, in accordance with some embodiments, phase delay circuits 120 and/or 122 may be added in line, at either end 114, 116 of, or at locations along RF transmission line 108 for radiation pattern, efficiency, and bandwidth control. For example, lumped-circuit phase-delay element 120, realized on a printed circuit board (PCB), can be coupled with the first end 114 of RF transmission line 108 and with first radiator element 104, and/or lumped-circuit phase-delay element 122, realized on a flexible PCB, can be coupled with the second end 116 of RF transmission line 108 and with second radiator element 106. Alternatively, the transmission line 108 can be split into multiple transmission line sections, and lumped-circuit phase-delay elements can be similarly coupled between sections.

Unlike antenna 100, traditional portable radios tend to feature a single antenna external to the radio housing, mounted about the radio top face and extending upwards. This kind of antenna is frequently referred to as a monopole. Depending on a monopole's physical length, its operation is typically characterized as "quarter-wave" or "half-wave". For instance, most 7/800 MHz public-safety radios feature a quarter-wave monopole that measures about 9 cm in length, or a half-wave monopole that measures about 18 cm in length. Hence, the quarter-wave monopole offers ergonomic advantages since it would interfere less than a half-wave monopole with the user body and extremities, for example when the radio is carried in a belt-hosted holster. However, the half-wave monopole typically features superior performance in terms of communication range, the reason being that its radiation pattern features higher gain than the quarter-wave monopole in directions at and about an azimuth plane, where other radios or infrastructure antennas engaged in the communication are typically located. In most cases, for typical realistic size portable radios existing today (roughly about 12 cm to 18 cm long excluding the antenna) and operating in the 7/800 MHz band, the quarter-wave monopole features a so-called "down-tilt" radiation pattern, which features peak gain along directions pointing well into the lower hemisphere (considering the radio placed vertically with the monopole pointing towards the top hemisphere.) Instead the half-wave monopole features a balanced radiation pattern with peak gain in directions at and about the azimuth plane separating the top and bottom hemisphere. Such a marked difference is due to the fundamental reliance of the quarter-wave monopole on the electrical counterpoise provided by the radio chassis (comprising elements such as metal housing parts, PCBs, displays, batteries, to name a few), which provides an enabling function to the quarter-wave monopole. Thus, the RF current distribution induced in the chassis to complement the quarter-wave RF current waveform supported by a quarter-wave monopole is responsible for the formation of a down-tilt radiation pattern.

Contrary to the quarter-wave monopole, a half-wave monopole is another single antenna external to the radio housing, mounted about the radio top face and extending upwards. This kind of antenna relies rather weakly on the counterpoise function by the radio chassis since a complete RF current half-wave, featuring substantially mutually compensating electrical charge distributions at its top and bottom ends, which yields a dipole-like radiation pattern exhibiting peak gain in directions at and about the azimuth plane, can be supported by the antenna structure itself. Thus, the essential RF current distribution induced in the chassis to complement the quarter-wave RF current waveform supported by a quarter-wave monopole is responsible for the formation of a down-tilt radiation pattern.

In accordance with the embodiments, manipulating the RF current distribution on the radio chassis 102 provides an effective approach to alter the radiation pattern with the purpose of increasing gain in directions at and about the azimuth plane even when a quarter-wave monopole is employed as the external antenna. In accordance with the embodiments, placing an additional radiator element, excited with a replica of the transmit signal, substantially on the opposite side of the radio chassis represents an effective approach to achieve the stated purpose of radiation pattern, efficiency, and bandwidth goals concurrently while preserving desirable radio features related to size and form factor. Because of radio ergonomics, the additional radiator element, for instance first radiator element 104 in FIG. 1, is preferably integrated in the interior of the radio housing.

Several different ways can be envisioned to implement this pattern alteration method using the additional interior radiator element 104. The approach provided by the various embodiments is deemed preferable since it permits the achievement of radiation pattern, efficiency, bandwidth goals concurrently while preserving desirable radio features, namely: a single RF source, ability to support multi-band operation, avoidance of high-power RF switches, reliable antenna performance even in difficult electromagnetic environments (e.g. radio placed on a metal surface, or handheld), and others.

More specifically, the simultaneous feed to all radiators 104, 106 from the single RF feed port 118 advantageously negates the need for RF switches, such as high power RF power switches, that would be required in some multi-port antenna configurations to select the radiator element providing the most beneficial radiation pattern, in order to exploit antenna diversity gain at the expense of increased radio device complexity. The elimination of high power switches makes the antenna configuration particularly attractive for land mobile radio (LMR) applications where these switches are voluminous and expensive.

In accordance with some embodiments, the ground reference mass 102 may comprise at least one of: a chassis device enclosure, a PCB, a flex PCB, a device battery, a device display, a device keypad, a device ground interconnecting structure, a coaxial cable transmission line shield, and another antenna. The ground reference mass 102 can be embodied as a metal chassis device enclosure, such as a radio metal chassis, formed of a suitable volume for containing the transmission line.

The ground reference mass 102 can be embodied as a PCB, for example, an FR4 PCB providing two ground planes, within which a stripline is formed as the RF transmission line 108. Alternatively, ground reference mass 102 can be embodied as a microstrip line formed by running a conducting strip separated from a ground plane by a dielectric layer. The microstrip, being an open transmission line susceptible to couple with the radiator elements 104, 106 throughout its physical extension, is less preferable than the stripline, unless it is placed within a suitably electromagnetically shielded metal chassis device enclosure.

The ground reference mass 102 can be embodied as a flex PCB wherein the flex PCB is formed of a low loss dielectric and the transmission line is formed of either the stripline or microstrip, or a series of interconnected sections of either of them, as described previously.

The ground reference mass 102 can be embodied as a device battery using the metal surrounding the battery as a chassis against which the transmission line can be coupled against, such as with metal clips providing ground connections for the transmission line ground structure 110 along the transmission line 108 route.

The ground reference mass 102 can be embodied as a device display wherein the device display has a ground structure (e.g. a metallic bezel), which may be used as part of the mass. The ground structure of the display PCB can be connected to the braid (ground structure 110) of a coaxial cable (transmission line 108) with metal clips.

The ground reference mass 102 can be embodied as a device keypad wherein the device keypad has a ground structure (e.g. a ground layer of a flexible PCB hosting the keypad push sensors), which may be used as part of the mass.

The ground reference mass 102 can be embodied as an interconnecting structure formed of spring contacts joining ground structures of different PCBs (e.g. joining the outermost ground layers of multilayer PCBs).

The ground reference mass 102 can be embodied as a coaxial cable shield in which portions of the shield are used as attachment points for the ground structure 110 of the transmission line 108 or for other elements of ground reference mass 102.

The ground reference mass 102 can be embodied as another antenna, for example, another antenna that operates in a distinctive band. For example, at LMR RF frequencies (VHF, UHF, 7/800 MHz bands) the metal of a long term evolution (LTE) antenna, which may be operational in bands above 1900 MHz, can be used as a ground reference mass for LMR antenna 100.

Combinations of the above can also be used to create a ground reference mass 102. In accordance with the various embodiments, the ground reference mass 102 of antenna 100 is formed of substantial metallic portions which are adequate for supporting RF currents that provide said essential electrical counterpoise enabling function for the radiator elements of antenna 100.

In accordance with some of the embodiments, each section of the radio frequency transmission line 108 may comprise one or more of: a coaxial cable, a stripline, a microstrip, a waveguide, and a transmission line interconnecting structure. The device transmission line interconnecting structure may comprise a conventional coaxial connector, board to board RF interconnection, microstrip to stripline transitions hosted within a PCB, to name a few.

In accordance with some of the embodiments, the radio frequency transmission line signal structure 112 may comprise one or more of: a coaxial cable center conductor, a stripline center conductor, a microstrip signal conductor, a waveguide field exciter, and a transmission line interconnecting structure signal conductor.

In accordance with some of the embodiments, the radio frequency transmission line ground structure 110 may comprise one or more of: a coaxial cable external shield, a stripline ground reference surfaces, a microstrip ground reference surface, a waveguide wall, and a transmission line interconnecting structure ground structure.

As mentioned previously, the antenna 100 may further comprise a plurality of signal phase and/or amplitude altering circuits 120, 122 which may be cascaded along the RF transmission line 108 and/or placed at its ends 114 and/or 116. The plurality of signal phase and/or amplitude altering circuits may comprise one or more of: a passive lumped-circuit component, a passive distributed circuit component (such as a microstrip, stripline, and/or RF stub, and the like), a microstrip filter, a printed transmission line of arbitrary impedance, a reconfigurable circuit component (such as a switch, a variable capacitor and/or variable inductor), an active circuit component (such as an amplifier, an isolator, to name a few), a reciprocal circuit component (such as a directional coupler, a filter, and the like), and a non reciprocal circuit component (such as an isolator, a circulator, a bi-directional amplifier, and the like). Reciprocal signal phase and/or amplitude altering circuits feature in general a transfer function, defined for instance as the ratio between the Laplace or Fourier transforms of the output and input signals at its suitably defined output and input RF ports, that operates on both magnitude and phase of said input signals.

In accordance with some of the embodiments, the first radiator element 104 may comprise sufficient metallic portions for supporting RF currents, and the second radiator element 106 may also comprise sufficient metallic portions for supporting RF currents.

In accordance with some of the embodiments, the ground structure 110 of transmission line 108 may be galvanically connected to the ground reference mass 102 at a plurality of locations along the transmission line 108. In accordance with the some of the embodiments, the plurality of locations may be distributed along the transmission line 108 so that a distance between successive locations is a predetermined small fraction of a wavelength corresponding to a highest frequency associated with a plurality of operating frequency bands intended for the antenna 100.

In accordance with some of the embodiments, the transmission line 108 is contained within a volume of the ground reference mass 102. Alternatively, the transmission line 108 is strongly capacitively coupled externally to the ground reference mass at a plurality of locations along the transmission line 108 so that a distance between successive locations is a predetermined small fraction of a wavelength corresponding to a highest frequency associated with a plurality of operating frequency bands intended for the antenna 100.

Figure 2:
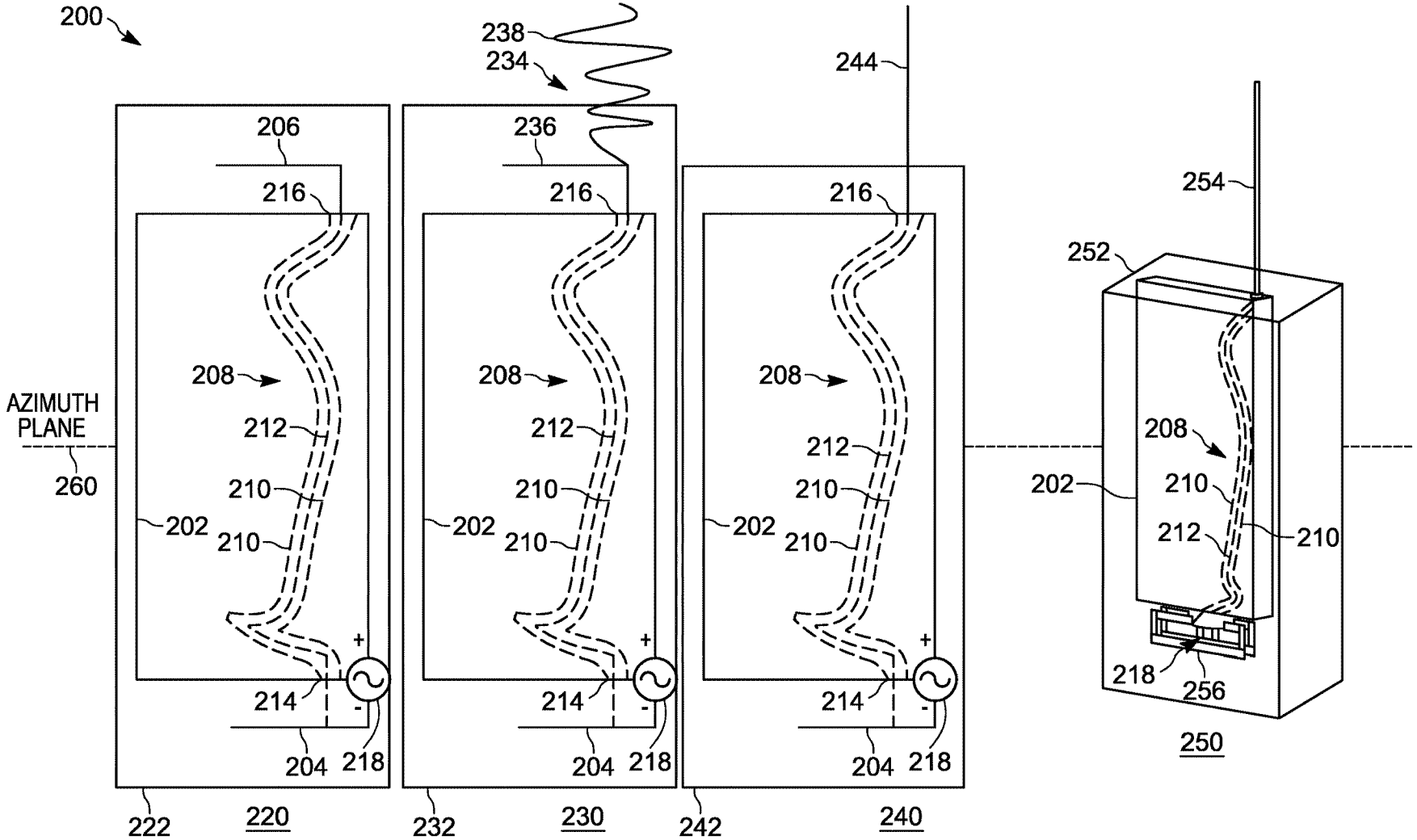
FIG. 2 depicts different examples of radios incorporating an antenna formed in accordance with various embodiments.

FIG. 2 depicts representations of various radio examples 200 incorporating an antenna formed in accordance with some of the embodiments. A first radio embodiment 220 comprises a housing 222 having a chassis or PCB providing a ground reference mass 202. The antenna comprises a first radiating element 204 electromagnetically coupled to the ground reference mass 202. The antenna further comprises a second radiating element 206 is electromagnetically coupled to the ground reference mass 202. In radio 220, the first radiator element 204 is formed as a bottom antenna when the radio is vertical, and the second radiator element 206 is formed as a top antenna. Both the first radiator element 204 and the second radiator element 206 are contained within housing 222.

In accordance with the embodiments, the antenna further comprises a single RF port 218 coupled with the ground reference mass 202 and with the first radiating element 204. For example, the RF feed port 218 may comprise a signal terminal coupled with first radiator element 204, said signal terminal being connected to a RF transceiver hosted within the chassis or PCB providing a ground reference mass 202. The antenna further comprises a RF transmission line 208 having a first end 214 and a second end 216. The transmission line 208 is embedded in the chassis or PCB ground reference mass 202 and comprises a ground structure 210 and signal structure 212. Signal phase and/or amplitude altering circuits (not shown) may be coupled at either ends and/or between sections of RF transmission line 208.

In accordance with the embodiments, the first radiating element 204 is electromagnetically excited through the radio-frequency port 218. The first radiating element 204 is further electromagnetically coupled to the signal structure 212 at the first end 214 of the RF transmission line 208. The electromagnetic excitation may be achieved by having the first radiating element 204 come into galvanic contact or electromagnetic coupling with a RF transceiver signal terminal of RF port 218.

In accordance with the embodiments, the second radiating element 206 is electromagnetically coupled to the signal structure 212 at the second end 216 of the RF transmission line 208. In this embodiment 220, the second radiating element 206 is located entirely within the top portion of the radio housing 222. The first radiator element 204 and the second radiator element 206 may be designed, in conjunction with the transfer function of RF transmission line 208, to enable wireless connectivity across a plurality of communication bands, for instance among the VHF, UHF, and 7/800 MHz bands.

A second radio embodiment 230 comprises a housing 232 having a chassis or PCB providing the ground reference mass 202 and contains similar elements to the first radio 220, but in accordance with this embodiment, provides a hybrid second radiator element 234. In accordance with this embodiment, the hybrid second radiator element 234 is formed of an internal radiator sub-element 236 coupled with an external radiator sub-element 238. Embodiment 230 provides an example where first radiator element 214 may be designed for operating in a first communication band (e.g. 7/800 MHz) while performing essentially a RF pass-through function in other bands at lower frequency ranges (e.g., VHF and UHF) where it is electrically-small, and the second radiator element 234 may be designed for operating in a partially overlapping set of communication bands (e.g., VHF and 7/800 MHz, or UHF and 7/800 MHz, or VHF and UHF and 7/800 MHz) or in a non overlapping set of communication bands (e.g. VHF and UHF, or VHF only, or UHF only) relative to first radiator element 214. In the case where second radiator element 234 operates in a non overlapping set of communication bands relative to first radiator element 214, the aforementioned benefit of a balanced radiation pattern may not be necessarily attained in the 7/800 MHz band. However, this configuration may still provide acceptable performance for portable radios used in a dense urban setting (e.g. in high rise building areas) since first radiator element 214 may produce an up-tilt radiation pattern suitable for reliable communication with infrastructure antennas placed at high locations on towers and buildings.

A third radio embodiment 240 comprises a housing 242 having the chassis or PCB providing the ground reference mass 202 and contains similar elements to the first radio 220, but in accordance with this embodiment, provides a single external second radiator element 244. While shown as a straight wire monopole antenna 244, it is appreciated that other monopole antenna structures known in the art, such as a helical structure could be utilized. In this case, the antenna provides the advantage that second radiator element 244 can be a conventional quarter-wave monopole, which is significantly shorter than a half-wave monopole as discussed earlier, yet a radiation pattern similar to a half-wave monopole, with peak gain in directions at and about an azimuth plane 260, is indeed obtained. Therefore, the antenna yields the benefit of smaller overall radio size without performance degradation relative to a portable radio equipped with a half-wave monopole.

A fourth radio embodiment 250 comprises a housing 252 having the chassis or PCB providing the ground reference mass 202 and contains similar elements to the first radio 220, but in accordance with this embodiment, provides a differently shaped first internal radiator element 256 at the bottom end of the radio and a single external radiator element 254 at the upper end of the radio. While shown as a straight wire monopole antenna 254, it is appreciated that other antenna structures, such as a helical structure, could be utilized. This embodiment is provide to illustrate that the shape of the internal first radiating element 256 can be varied using known techniques to provide operation within a predefined set of communication bands. For instance, first radiating element 256 can be a single-band or multi-band Planar Inverted F-Antenna (PIFA).

The four radio examples are provided to illustrate that the second radiator element 206, 234, 244, 254, respectively can be varied as either internal only, external only or a combination thereof and designed to operate over a number of communication bands. The first radiator element 204, 256, respectively can also be varied, however for the practical purposes of having a handheld radio stand up on its base, the first radiating element 204 and variations thereof remains internal to the radio housing 222, 232, 242, 252, respectively.

The embodiments enable a plurality of radiator elements to be used with a single RF feed port for use with a single RF transceiver of a portable radio, each of the radiator elements being fed simultaneously. Improved antenna performance has been achieved for a smaller size radio using the internal bottom radiator element 204 and internal top radiator element 206 configuration of radio 220 (and similarly for radios 230, 240, 250). The bottom radiator element offers improved radiation pattern and bandwidth. In particular, bandwidth is mainly limited by the bottom radiator element since it is preferably inside the radio housing and is preferably as small as possible to achieve desirable handset volume goals. Indeed, the antenna features an internal first radiator element 204 with is loaded by the predominantly resistive impedance presented at the first end 214 of RF transmission line 208. The impedance presented at the first end 214 of RF transmission line 208 is predominantly resistive because the RF transmission line 208 is loaded at its second end 216 by second radiator element 206, which may be tuned in an overlapping set of bands relative to first radiator element 204. It is well known that and internal antenna (e.g. a PIFA) features typically narrow bandwidth, and that its bandwidth may be significantly broadened by loading it with resistive elements coupled to its ground structure. However, loading an antenna with resistive elements reduces its efficiency dramatically because a significant portion of the antenna RF input power is dissipated on said resistive elements and is not radiated. In the case of the antenna formed in accordance with the embodiments, however, the predominantly resistive element loading first radiator element 204 corresponds to the transformed impedance of second radiator element 206, said transformation being performed by the transfer function of RF transmission line 208. Therefore, the portion of RF input power produced by RF port 218 that flows into the first end 214 of RF transmission line 208 ends up being mostly radiated by second radiator element 206 since RF transmission line 208 is preferably designed to exhibit very low RF losses, contributing constructively to the efficient operation of antenna 200, further producing a desirably balanced radiation pattern with peak gain in directions at and about the azimuth plane 260.

As described previously, signal phase and/or amplitude altering circuits can be added along the transmission line for radiation pattern control. As mentioned previously, signal phase and/or amplitude altering circuits may include a reconfigurable circuit components (such as a switch, a variable capacitor and/or variable inductor), which can be advantageously operated by a controller, in response to user, sensor, system driven inputs (for example adaptive beam steering algorithms) to alter dynamically the transfer function of RF transmission line 208 in order to realize a variety of different radiation patterns. For example, the reconfigurable circuit components may produce a transfer function that tilts the beam upwards or downwards in response to sensors inputs indicating, for instance, whether the radio is being operated while worn about a user's belt, or system inputs such as a Received Signal Strength Indication (RSSI) reading.

Figure 3:
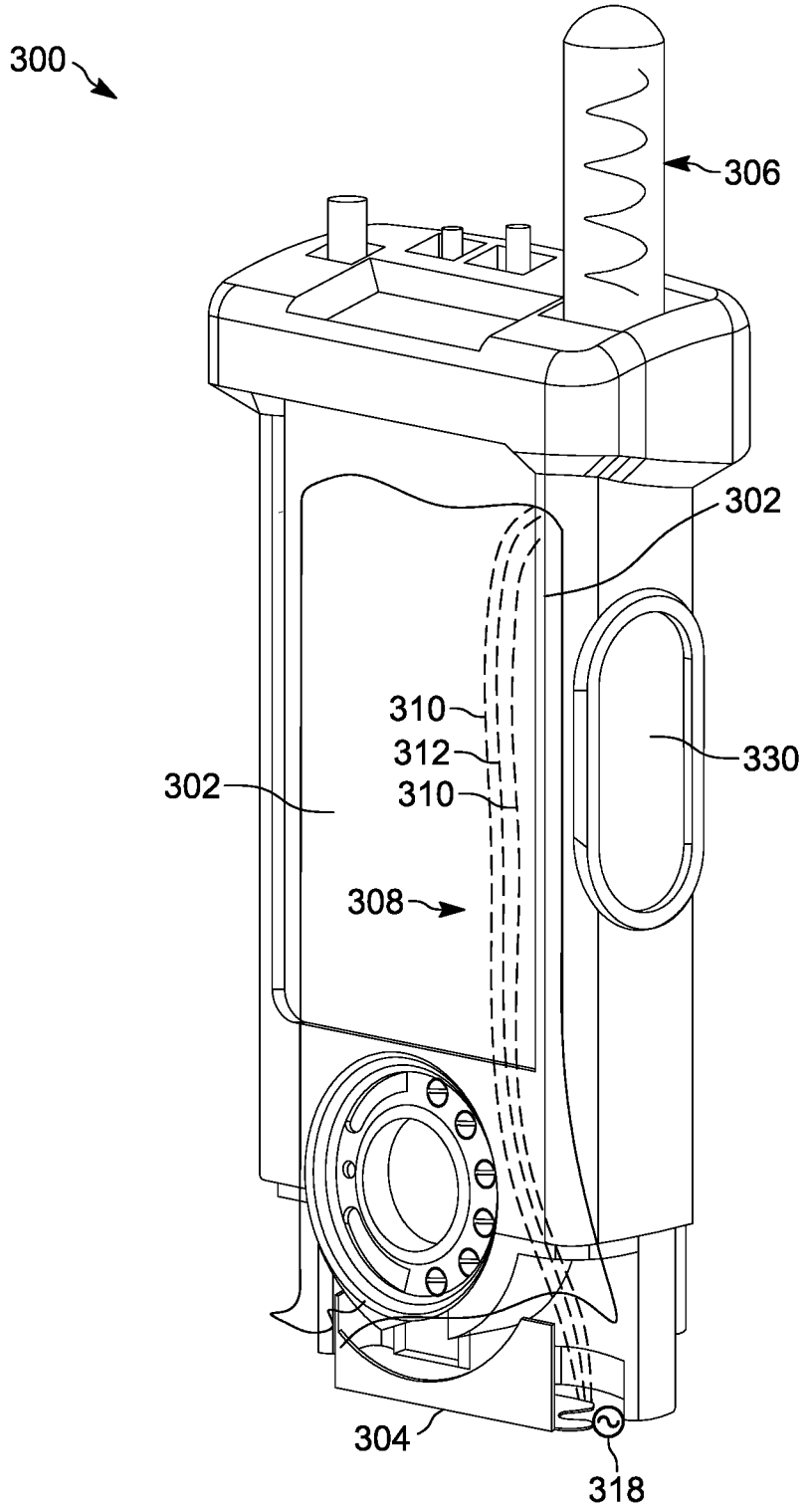
FIG. 3 is a cut-away view of a portable radio incorporating an antenna formed in accordance with some embodiments.

FIG. 3 is a cut-away view of a portable radio 300 incorporating an antenna formed in accordance with some embodiments. Portable radio 300 is a multiband two-way radio having push-to-talk button 330 for use by a variety of different public-safety agencies that operate their radios over different frequency bands and that need to be able to communicate with each other. Operation over the plurality of different frequency bands is facilitated through the antenna structure comprising first and second radiator elements 304, 306 which are respectively provided at the bottom and top of the portable radio device 300. The first radiator element 304 is embedded in the bottom of the radio housing, while the second radiator element 306 is located external to the housing at the top end. The top external antenna 306 may be, for example, a helical antenna, which performs similarly to a straight-wire quarter-wave monopole for 7/800 MHz operation. Alternatively the external antenna may be embodied as a multi-band whip antenna, which when combined with the internal bottom antenna will provide for multi-band operation while preserving 7/800 MHz operation, but with the advantage of overall shorter height, which will be described in FIG. 4.

A transmission line 308 joins the two radiator elements 304, 306. The bottom radiator element 304 features at least two legs: (i) one used for RF-feeding the antenna from a RF transceiver hosted by the radio PCB or chassis, and (ii) another used to couple to the RF transmission line 308 (e.g., coaxial cable, stripline) that crosses the whole device upwards, inside the radio housing, and feeds the top antenna element 306.

The bottom radiator element 304 and the suitably designed transmission line 308 advantageously improve the antenna radiation pattern as described in the foregoing. The reduced length of the external antenna 306 (about 4 cm or less) compared to a half-wave monopole (about 18 cm) also improves the radio usability while preserving a desirably balanced radiation pattern with peak gain in directions at and about the azimuth plane.

In accordance with the embodiments, the transmission line 308 is non-floating transmission line. For example, the transmission line 308 may comprise a coaxial cable totally embedded within the radio shielded metal chassis 302, or its shield may be grounded to it at many points if not continuously along its upward path. The transmission line may comprise a stripline embedded in a PCB, said PCB forming part of the ground reference mass 302. In devices with heterogeneous grounding structures featuring, for instance, PCBs and cable connections, a mix of stripline and cables may be used to realize the transmission line function.

In accordance with some embodiments, phasing, matching, and filtering circuit(s) can be provided at either or both ends or between sections of the transmission line 308, to control antenna pattern and frequency response. The antenna structure of the various embodiments enables the simultaneous feeding of multiple radiator elements with a single-port transceiver, avoiding any RF power splitters that would require impedance step-up/down to mitigate mismatch at the transceiver port, or a lossy splitter that would reduce efficiency. The antenna of the various embodiments avoids the use of high-power switches to address multiple radiator elements operating in distinct communication bands since all antenna elements are fed simultaneously.

Figure 4:
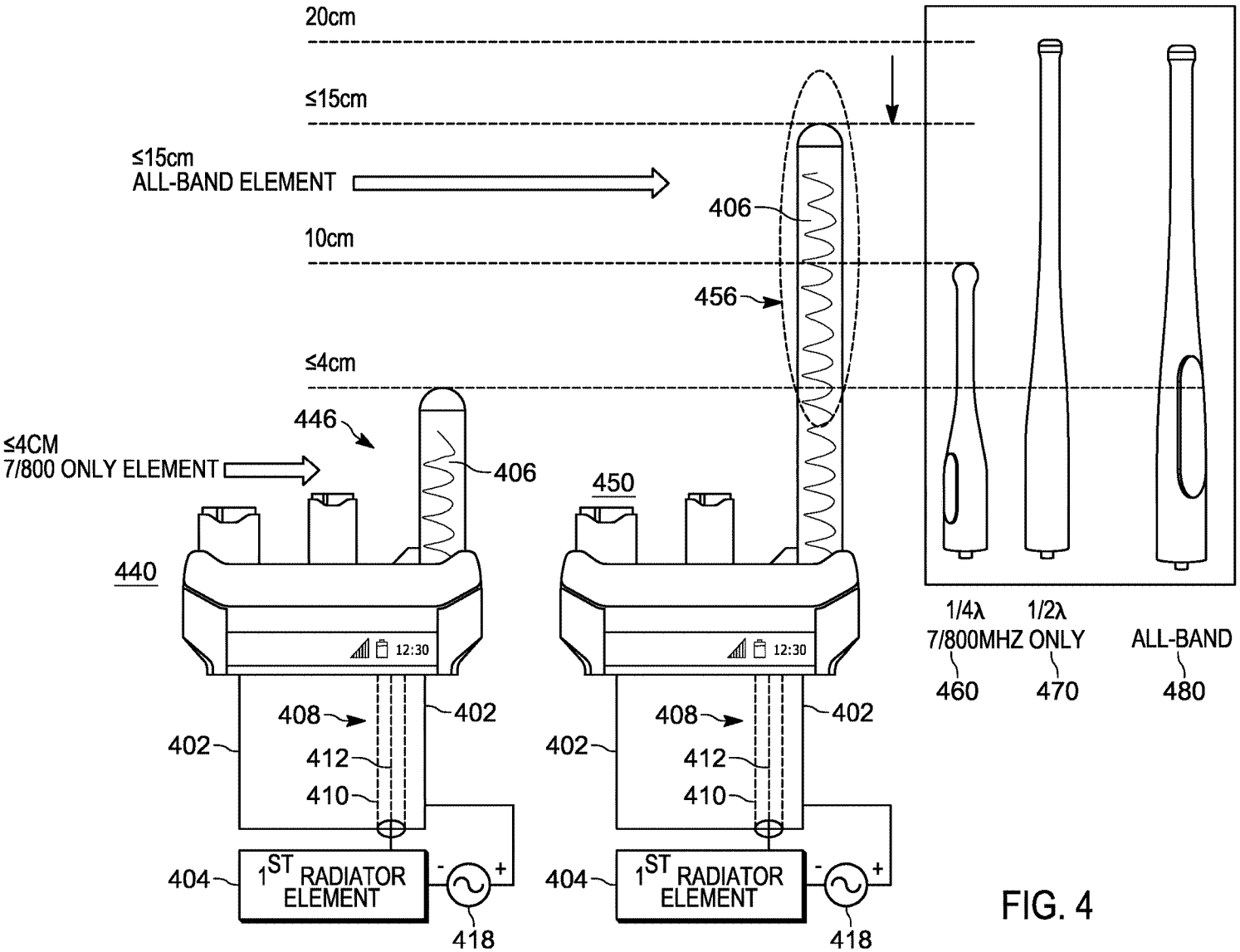
FIG. 4 shows a height comparison of top-located radiator elements for antenna structures formed in accordance with some embodiments.

FIG. 4 shows a height comparison of top-located radiator elements for antenna structures formed in accordance with some embodiments. First and second radios are outlined in which a radio 440 provides 7/800 MHz radio operation using the antenna formed in accordance with some of the embodiments. Another radio 450 is shown which provides multiband operation utilizing the antenna structure from some of the embodiments.

The first radio 440 comprises ground reference mass 402 in the form of a chassis or PCB, first internal bottom located radiator element 404, second external top located radiator element 406, and transmission line 408 as previously described. A single RF feed 418 is coupled with the signal terminal of a RF transceiver hosted within ground reference mass 402. Alternatively, the single RF feed 418 is coupled with the signal terminal of a RF transceiver hosted within first radiator element 404. The transmission line 408 is routed within and/or strongly capacitively coupled along the length of the ground reference mass 402 between the first radiator element 404 and the second radiator element 406. Said capacitive coupling should preferably be strong enough to result essentially equivalent to a galvanic connection across all the operating bands of the antenna. This embodiment provides for an external antenna of less than 4 cm in height and provides for 7/800 MHz radio operation. A quarter wave antenna 460 which would have previously been needed for 7/800 MHz operation, having a length of approximately 10 cm, or longer half-wave monopole 470 having a length of approximately 20 cm, which would have previously been needed for 7/800 MHz operation with desirably balanced radiation pattern with peak gain in directions at and about the azimuth plane, have been replaced by a 4 cm stubby antenna 446 containing second top radiator element 406, which when combined with the bottom radiator element 404 provides performance approaching that of a half-wave monopole, preserving a desirably balanced radiation pattern with peak gain in directions at and about the azimuth plane.

The second radio 450 comprises the ground reference mass 402 in the form of the chassis or PCB, a first internal bottom located radiator element 404, a second external top located radiator element 406, and a transmission line 408 as previously described. A single RF feed 418 is coupled with the signal terminal of a RF transceiver hosted within the ground reference mass 402. The transmission line 408 is coupled along the length of the ground reference mass 402 between the first radiator element 404 and the second radiator element 406, similarly to radio 440. This embodiment provides for an external all-band antenna 456 of less than 15 cm in height for an all-band radio (7/800 MHz, UHF, and VHF). A longer all-band whip antenna 480, which would have been used for 7/800 MHz, UHF, and VHF, having a length of approximately 20 cm has been replaced by the 15 cm antenna 456, containing the second radiator element 406. The 15 cm second radiator element 406 when combined with the bottom radiator element 404 through the transmission line 408 provides for multiband performance and with desirably balanced radiation pattern with peak gain in directions at and about the azimuth plane in the 7/800 MHz band. This size reduction is achieved since all-band antenna 456 does not need to incorporate means to produce a desirably balanced radiation pattern with peak gain in directions at and about the azimuth plane, since the desirably balanced radiation pattern is obtained in combination with first radiator element 404. Unlike approaches that focus on a single radiator element, radio 450 provides better overall performance via the combination of "top" and "bottom" radiator elements 456, 404 coupled through the transmission line 408. The embedded element 404 preserves performance in the 7/800 MHz band, while providing for operation in the UHF and VHF bands.

Figure 5:
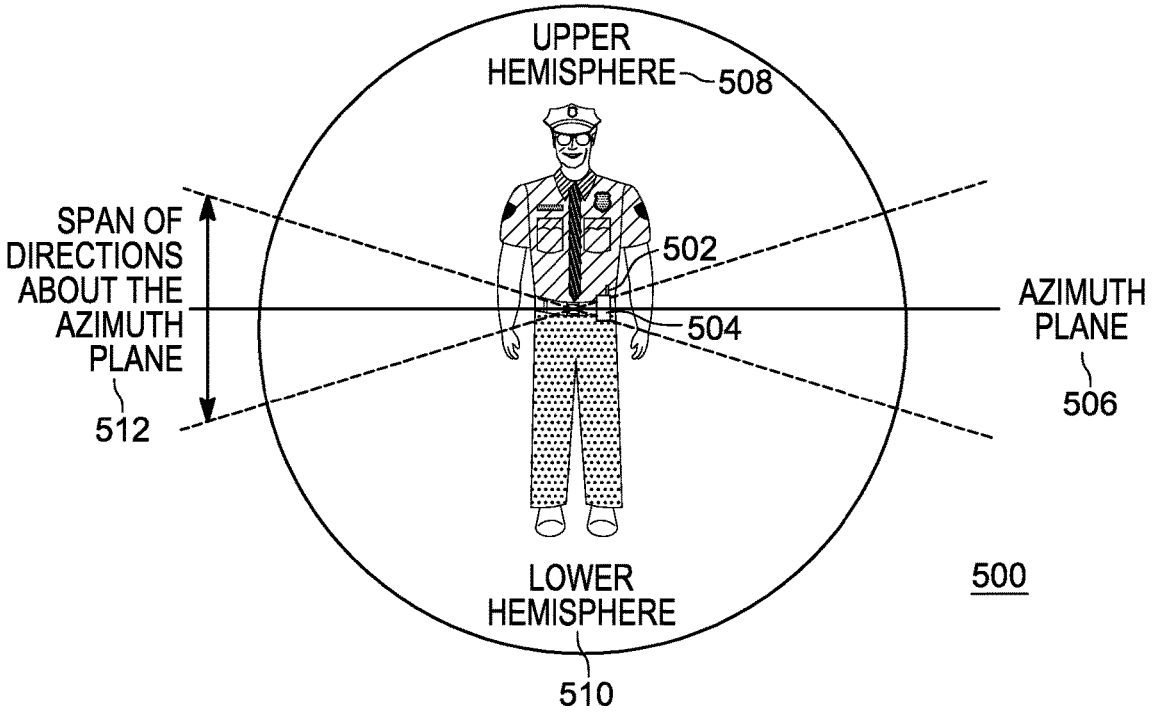
FIG. 5. shows a reference frame to illustrate desirable RF emission directions for antenna structures featuring balanced radiation patterns formed in accordance with the embodiments and belt-worn by a user in substantially vertical orientation.

FIG. 5. shows a reference frame 500 to illustrate desirable RF emission directions for antenna structures featuring balanced radiation patterns formed in accordance with the embodiments and belt-worn by a user in substantially vertical orientation. A radio 502 comprises, as previously described, an external antenna element 504 and an internal antenna element with a transmission line coupled therebetween, embedded within or routed along a ground reference mass, and a single RF feed port, as previously described. An azimuth plane 506 divides the surrounding space into an upper hemisphere 508 and a lower hemisphere 510. The radiation patterns for antenna 504 are substantially balanced and thus emit RF energy mostly towards a span of directions 512 at and about azimuth plane 506.

Accordingly, there has been provided is an antenna formed by placing a first radiator element at one side of a device, fed through a RF source, and terminated on the input of a transmission line that is routed within the chassis or PCB towards another radiator element placed on another side of the device. From an RF point of view, the ground of the transmission line does not need to support radiating currents as the embedment within, or the strong capacitive coupling or galvanic connection with, the chassis or PCB ground provides for a substantially non-interfering behavior of the transmission line with the antenna RF radiation.

The antenna structure of the embodiments allows for reliable multi-band operation to be incorporated into portable communication devices, such as public-safety two-way radios while decreasing the size of the portable device.

The antenna enables improved radiation pattern synthesis (e.g., avoiding "down-tilt" patterns) through the combination of the radiation pattern effect from top and bottom antenna elements. The balance of the top and bottom approach facilitates operating over multiple bands as well as adaptive beam-control opportunities. The embodiments provide preferably for a bottom-fed embedded radiator element terminated on a transmission line connected to another radiator element, which represents a prevalently resistive load, thereby increasing the bandwidth of the bottom radiator element.

Beam control through phasing circuit(s) along the transmission line is readily achievable since the transmission line may be embedded in an electromagnetically shielded environment where connections with a PCB-hosted phasing circuit can be conveniently realized without interfering with the antenna RF radiation. Additionally, the tuning components used to realize the variable phase shift may be subjected to less challenging voltage and current swings since the tuning components are located in a transmission line (low VSWR) environment, as opposed to being placed in high-Q matching circuits.

Placing the radiator elements at the top and bottom of the device mitigates potential hand and "metal table" effects. It has been verified that a ground plane at 2 mm from the bottom radiator element does not produce detrimental impedance mismatch.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An antenna, comprising:
- a ground reference mass;
- a first radiating element electromagnetically coupled to the ground reference mass;
- a second radiating element electromagnetically coupled to the ground reference mass;
- a single radio-frequency (RF) port established between the ground reference mass and the first radiating element;
- a radio-frequency transmission line having a first end and a second end, the radio-frequency transmission line being formed of a ground structure and a signal structure, the radio-frequency transmission line being contained within a volume of the ground reference mass;
- the first radiating element being electromagnetically excited through the single RF feed port and electromagnetically coupled to the signal structure at the first end of the radio-frequency transmission line; and
- the second radiating element being electromagnetically coupled to the signal structure at the second end of the radio-frequency transmission line.

2. The antenna of claim 1, wherein the ground reference mass comprises at least one of:
- a printed circuit board;
- a flex circuit;
- a device chassis enclosure;
- a device battery;
- a device display;
- a device keypad;
- a device ground interconnecting structure;
- a coaxial cable transmission line shield; and
- another antenna.

3. The antenna of claim 1, wherein the radio frequency transmission line comprises one or more of:
- a coaxial cable;
- a stripline;
- a microstrip;
- a waveguide; and
- a device transmission line interconnecting structure.

4. The antenna of claim 1, wherein the radio frequency transmission line signal structure comprises one or more of:
- a coaxial cable center conductor;
- a stripline center conductor;
- a microstrip signal conductor;
- a waveguide field exciter; and
- a device transmission line interconnecting structure signal conductor.

5. The antenna of claim 3, wherein the radio frequency transmission line ground structure comprises one or more of:
- a coaxial cable external conducting structure, and
- a stripline ground reference surfaces, and
- a microstrip ground reference surface, and
- a waveguide wall, and
- a device transmission line interconnecting structure ground structure.

6. The antenna of claim 1, wherein a plurality of signal phase and/or amplitude altering circuits are cascaded along the radio frequency transmission line, said plurality of circuits comprising one or more of:
- a passive lumped circuit component;
- a passive distributed circuit component;
- a reconfigurable circuit component;
- an active circuit component;
- a reciprocal circuit component; and
- a non reciprocal circuit component.

7. The antenna of claim 1, wherein the ground reference mass comprises metallic portions for supporting RF currents.

8. The antenna of claim 1, wherein the first radiator element comprises metallic portions for supporting RF currents.

9. The antenna of claim 1, wherein the second radiator element comprises metallic portions for supporting RF currents.

10. The antenna of claim 1, wherein the ground structure of the transmission line is galvanically connected to the ground reference mass at a plurality of locations along the transmission line.

11. The antenna of claim 10, wherein the plurality of locations are distributed along the transmission line so that the distance between successive locations is less than a predetermined fraction of a wavelength corresponding to a highest frequency of an antenna operating frequency band for the antenna.

12. A portable radio, comprising:
- a housing having upper, lower, and side housing portions;
- a ground reference mass distributed from the bottom housing portion to the top housing portion;
- a controller;
- a transceiver coupled to the controller; and
- an antenna coupled to the transceiver via a single radio frequency (RF) port, the single RF port being located in the lower housing portion and electrically connected to the ground reference mass and configured for receiving and transmitting a RF signal, the antenna comprising:
  - a first radiator element located in the lower housing portion, the first radiator element being electrically connected to the single RF port;
  - a second radiator element located in the upper housing portion being tuned and matched with the first radiator element for a predetermined response;
  - a transmission line between the first radiator element and the second radiator element, the transmission line being embedded into the ground reference mass, the transmission line having phase shift tuning capability.

13. The portable radio of claim 12, wherein the single RF port and the antenna provides appropriate impedance matching to maximize radiation efficiency.

14. The portable radio of claim 13, wherein the appropriate impedance is an impedance other than 50 ohms.

15. The portable radio of claim 12, wherein the transmission line crosses the whole device upwards and feeds the top antenna element(s).

16. The portable radio of claim 12, wherein the transmission line is a non-floating transmission line.

17. The portable radio of claim 12, wherein the transmission line comprises a coaxial cable totally embedded within a radio shielded metal chassis.

18. The portable radio of claim 12, wherein the transmission line comprises a stripline embedded in a PCB ground.

19. The portable radio of claim 12, further comprising reconfigurable circuit components which produce a transmission line transfer function operated by a controller, in response to at least one of: a user input, a sensor input, and a system driven input that tilts a beam upwards or downwards.

20. A portable radio comprising:

a housing having upper and lower sides;

a chassis providing a ground plane expanding between the upper and lower sides of the housing;

a transmission line routed within the chassis, the chassis being non-interfering to the transmission line;

a RF source coupled against the chassis at the lower side of the housing;

a first radiator element placed at the lower side of the housing, the first radiator element being fed through the radio frequency (RF) source, the first radiator element being terminated at an input of the transmission line; and a second radiator element placed on the upper side of the housing and coupled to an output of the transmission line.

* * * * *